United States Patent [19]

Patel et al.

[11] Patent Number: 4,743,357

[45] Date of Patent: May 10, 1988

[54] CATALYTIC PROCESS FOR PRODUCTION OF LIGHT HYDROCARBONS BY TREATMENT OF HEAVY HYDROCARBONS WITH WATER

[75] Inventors: Kundanbhai M. Patel, Landing; Andiappan K. S. Murthy, Lake Hiawatha; Alex Y. Bekker, Teaneck, all of N.J.

[73] Assignee: Allied Corporation, Morris Township, Morris County, N.J.

[21] Appl. No.: 813,357

[22] Filed: Dec. 26, 1985

Related U.S. Application Data

[63] Continuation of Ser. No. 565,329, Dec. 27, 1983, abandoned.

[51] Int. Cl.[4] ..... C10G 13/06; C10G 11/18

[52] U.S. Cl. ..... 208/113; 208/112; 208/116; 208/121; 208/251 R; 585/653

[58] Field of Search ..... 208/112, 113, 116, 121, 208/251 R, 251 H; 585/653

[56] References Cited

U.S. PATENT DOCUMENTS

| | | | |
|---|---|---|---|
| 2,135,332 | 11/1938 | Gary | 196/62 |
| 3,453,206 | 7/1969 | Gatsis et al. | 208/210 |
| 3,501,396 | 3/1970 | Gatsis | 208/216 |
| 3,586,621 | 6/1971 | Pitchford et al. | 208/112 |
| 3,676,331 | 7/1972 | Pitchford | 208/112 |
| 3,733,259 | 5/1973 | Wilson et al. | 208/86 |
| 3,960,706 | 6/1976 | McCollum et al. | 208/112 |
| 4,069,799 | 1/1978 | Bearden, Jr. et al. | 208/112 |
| 4,214,977 | 7/1980 | Ranganathan et al. | 208/108 |
| 4,298,460 | 11/1981 | Fujimori et al. | 208/121 |
| 4,325,812 | 4/1982 | Fujimori et al. | 208/119 |

*Primary Examiner*—Helen M. S. Sneed
*Assistant Examiner*—Chung K. Pak
*Attorney, Agent, or Firm*—Gale F. Matthews; Richard C. Stewart; Gerhard H. Fuchs

[57] ABSTRACT

A process for converting heavy hydrocarbons into light hydrocarbons which comprises contacting, in a reaction zone, a heavy hydrocarbon having an API gravity at 25° C. of less than about 20, such as Boscan heavy crude oil or tar sand bitumen, with a liquid comprising water and with an effective amount of selected catalyst materials such as iron (II and/or III) oxides, sulfides or sulfates, in the absence of externally added hydrogen, at a temperature between greater than about 340° and about 480° C. and at a pressure between about 1350 kPa (about 196 psig, about 13.2 atm) and about 15,000 kPa (about 2175 psig, about 148 atm), for a time sufficient to produce a residue and a vapor phase comprising light hydrocarbons, gaseous product and water, withdrawing the residue and said phase from the second zone; and recovering a light hydrocarbon product having an API gravity at 25° C. of greater than about 20 and substantially free of vanadium and nickel values, i.e., less than 50 ppm, preferably less than 30 ppm, a gaseous product, and a residue is disclosed.

13 Claims, 4 Drawing Sheets

CATALYTIC PROCESS FOR PRODUCTION OF LIGHT HYDROCARBONS BY TREATMENT OF HEAVY HYDROCARBONS WITH WATER

This application is a continuation of application Ser. No. 565,329, filed Dec. 27, 1983, abandoned.

CROSS-REFERENCE TO RELATED APPLICATION

This application is related to U.S. patent application Ser. No. 517,311, filed July 26, 1983, which is a continuation-in-part application of U.S. patent application Ser. No. 450,710, filed Dec. 17, 1982.

BACKGROUND OF THE INVENTION

The present invention relates to a process for catalytic conversion of heavy hydrocarbons with water to form light hydrocarbons, a gaseous product and a residue. More particularly, the present invention is directed to a process for treating heavy hydrocarbons containing organometallics, for example vanadium and nickel, organosulfur and organonitrogen compounds, and asphaltenes with water and an effective amount of selected catalytic materials such as iron oxides or sulfides at elevated temperatures and pressures, in the absence of externally added hydrogen, for a time sufficient to form a light hydrocarbon product, substantially free of vanadium and nickel, a gaseous product and a residue.

There exist enormous quantities of heavy hydrocarbons such as heavy petroleum crude oils and tar sand bitumen (the heavy hydrocarbons extracted from tar sands), as well as residual heavy hydrocarbon fractions obtained from heavy hydrocarbon crudes such as atmospheric tower bottoms products, vacuum tower bottoms products, crude oil residuum and heavy vacuum gas oils. These heavy crude and residual hydrocarbon streams contain large amounts of organometallic compounds, especially those containing nickel and vanadium, organosulfur and organonitrogen compounds, and asphaltenes (high molecular weight polycyclic, pentane insoluble materials). In addition, these heavy crude and residual hydrocarbons are viscous and as such require a greater degree of processing to convert them into liquid materials that can be transported easily.

A number of alternate physical and chemical routes have been and are still being developed for converting heavy hydrocarbon materials into lighter liquid and gaseous fuels. Among the approaches are physical separation processes such as vacuum distillation, steam distillation, and solvent deasphalting, various thermal conversion processes such as visbreaking, delayed coking, fluid coking and coke gasification, catalytic processes such as hydrotreating, hydrorefining and hydrocracking, as well as multistage catalytic and non-catalytic processes. Each of these approaches has one or more drawbacks. In physical separation processes such as vacuum distillation, steam distillation and solvent deasphalting, a liquid hydrocarbon fraction is recovered in low yield but the asphaltene and resinous materials are not converted into product and must be disposed of separately. The various thermal conversion processes such as visbreaking, delayed coking, fluid coking and coke gasification require high temperatures above 500° C. and generate a low quality by-product coke. In coke gasification, treatment of heavy hydrocarbons with steam and oxygen at high temperatures is necessary to produce a product gas, which must be utilized locally, and a limited yield of lighter liquid hydrocarbon product.

There are various processes for treating heavy hydrocarbons with and without water with specific externally supplied catalyst systems, or in some cases a second reactant, and externally supplied hydrogen or hydrogen donors at specified temperatures above the critical temperature of water and at specified pressures, from below to above the critical pressure of water.

U.S. Pat. No. 4,067,799 (Breaden, Jr. et al.) discloses a catalytic process for production of lower boiling hydrocarbon products by treating heavy hydrocarbonaceous oil with hydrogen gas in the presence of a catalyst comprising a metal (such as cobalt, nickel) phthalocyanine and a particulate iron component. However, the proces of U.S. Pat. No. 4,067,799 uses no water and the metal content of the lower boiling hydrocarbon product is not reported.

U.S. Pat. No. 4,214,977 (Ranganathan et al.) discloses a process for hydrocracking of heavy oils such as oils extracted from tar sands by use of an iron-coal catalyst in the presence of excess hydrogen gas. However, while the process produces light oils from tar sand bitumen, the process operates in the absence of water (except residual water present from the preparation of the specific catalyst) requires coal in combination with an iron catalyst to reduce coke deposition and there is no mention of the metal content of the lower hydrocarbon product.

U.S. Pat. Nos. 4,298,460 and 4,325,812 (both by Fujimori et al.) disclose two and three zone processes for cracking sulfur-containing heavy oils into light oils and producing significant quantities of hydrogen and coke. U.S. Pat. No. 4,298,460 discloses a three zone process for reaction of a sulfur-containing heavy oil with a reduced iron species to produce coke, hydrogen, hydrogen sulfide, desulfurized light oil of unspecified heavy metal content and the recycling of the iron-containing species in a two-step process. The reaction disclosed in U.S. Pat. No.: 4,298,460 is not catalytic but requires at least 2½ times (on a weight basis) as much iron-containing species as sulfur-containing oil; said reaction does not require the presence of water in the first zone but requires two separate zones to process the iron-containing species removed from the first zone and to produce significant quantities of hydrogen sulfide, hydrogen and coke. U.S. Pat. No. 4,325,812 discloses a two-zone process for cracking sulfur-containing heavy hydrocarbons into light oils and producing significant quantities of hydrogen. Like U.S. Pat. No. 4,298,460, U.S. Pat. No. 4,325,812 produces significant amounts of hydrogen and coke and is not really catalytic; at least equivalent amounts of sulfur-containing heavy oil and iron-containing species are contacted in the first zone. As in the case of U.S. Pat. No. B 4,298,460, the metal content of the product produced in U.S. Pat. No. 4,325,821 is not specified.

U.S. Pat. No. 3,453,206 (Gatsis et al.) discloses a multistage hydrorefining of petroleum crude oil wherein the heavy hydrocarbon feedstock is treated in a first reaction zone with a mixture of hydrogen and water at a temperature above the critical temperature of water and at a pressure of at least 1000 pounds per square inch gauge (psig) and in the absence of a catalyst; the product from a first zone is a liquid which is further treated with hydrogen in a second reaction zone in the presence of a catalyst at hydrorefining conditions. However, this process requires a separate processing step to supply relatively large quantities of hydrogen from expensive starting materials such as naptha or other hydrocarbon feeds.

U.S. Pat. No. 3,501,396 (Gatsis) discloses a process for desulfurizing and denitrifying oil which comprises mixing the oil with water at a temperature above the critical temperature of water up to about 427° C. (800° F.) and at a pressure in the range of from about 1000 to about 25000 psig and reacting the resulting mixture with externally supplied hydrogen in contact with a catalytic composite. The catalytic composite is characterized as a dual function catalyst which is acidic in nature and comprises a metallic component such as iridium, osmium, rhodium, ruthenium and mixtures thereof and an acidic carrier component having cracking activity.

U.S. Pat. No. 3,586,621 (Pitchford et al.) discloses a method for converting heavy hydrocarbon oils, residual hydrocarbon fractions, and solid carbonaceous materials to more useful gaseous and liquid products by contacting the material to be converted with a nickel spinel (nickel aluminate) catalyst promoted with a barium salt of an organic acid in the presence of steam.

U.S. Pat. No. 3,676,331 (Pitchford) discloses a method for upgrading hydrocarbons and thereby producing materials of low molecular weight and of reduced sulfur content (but unspecified metal content) and carbon residue by introducing water and a catalyst system containing at least two components into the crude hydrocarbon fraction. Suitable materials for use as the first component of the catalyst system are the $C_8$–$C_{40}$ carboxylic acid salts of barium, calcium, strontium, and magnesium. Suitable materials for use as the second component of the catalyst system are the $C_8$–$C_{40}$ carboxylic acid salts of nickel, cobalt and iron.

U.S. Pat. No. 3,733,259 (Wilson et al.) discloses a process for removing metals, asphaltenes, and sulfur from a heavy hydrocarbon oil. The process comprises dispersing the oil in water, maintaining this dispersion at a temperature between 399° C. and 454° C. (750° F. and 850° F.) and at a pressure between atmospheric and 100 psig, cooling the dispersion after at least one-half hour to form a stable water-asphaltene emulsion, separating the emulsion from the treated oil, adding hydrogen, and contacting the resulting treated oil with a hydrogenation catalyst in the presence of externally added hydrogen at a temperature between 260° C. and 482° C. (500° F. and 900° F.) and at a pressure between about 300 and 3000 psig.

SUMMARY OF THE INVENTION

It has been discovered that heavy hydrocarbons feedstocks containing vanadium and nickel values, may be converted into light hydrocarbon products substantially free of vanadium and nickel values by contacting the heavy hydrocarbon feedstocks with water, in the presence of an effective amount of at least one selected catalytic material, in the absence of externally added hydrogen, at selected pressure and temperature ranges. The pressure range selected to produce a light hydrocarbon product substantially free of vanadium and nickel values depended upon the heavy hydrocarbon feedstock; thereafter, the temperature range was selected to provide a sufficient quantity of light hydrocarbon product at acceptable reaction rates while avoiding coke formation.

Accordingly, the present invention provides a catalytic process for converting heavy hydrocarbons into light hydrocarbons which comprises:

(a) contacting, in a reaction zone, heavy hydrocarbons having an API gravity at 25° C. of less than about 20 with a liquid comprising water and with an effective amount of a catalytic material comprising at least one member selected from group consisting of phenanthrene, ammonium carbonate, formic acid, rhodium metal on alumina, mixtures of copper and zinc metals on alumina, and oxides, sulfides, sulfates, or halides of antimony, calcium, iron, tin or zinc, in the absence of externally added hydrogen, at a temperature between greater than about 340° C. and 480° C. and at a pressure between about 1350 kPa (about 196 psig, about 13.2 atm) and about 15,000 kPa (about 2175 psig, about 148 atm);

(b) maintaining the reaction zone under said temperature and pressure conditions in the absence of externally added hydrogen, for a time sufficient to produce a residue and a vapor phase comprising light hydrocarbons, gaseous product and water;

(c) withdrawing the residue and said phase from the reaction zone;

(d) separating said phase into a gaseous product, a liquid comprising water, and light hydrocarbon product having an API gravity at 25° C. of greater than about 20 and substantially free of vanadium and nickel values; and (e) recovering said light hydrocarbon product.

The present invention also provides a catalytic process for converting heavy hydrocarbons into light hydrocarbons which comprises:

(a) contacting, in a reaction zone, heavy hydrocarbons having an API gravity at 25° C. of less than about 20 and a total vanadium and nickel content between about 1000 and about 2000 ppm with a liquid comprising water and with an effective amount of a catalytic material comprising at least one member selected from the group consisting of phenanthrene, ammonium carbonate, formic acid, rhodium metal on alumina, mixtures of copper and zinc metals on alumina, and oxides, sulfides, sulfates, or halides of antimony, calcium, iron, tin or zinc, in the absence of externally added hydrogen, at a temperature between greater than about 340° C. and about 480° C., at a pressure between about 1350 kPa (about 196 psig, about 13.2 atm) and about 15,000 kPa (about 2175 psig, about 148 atm);

(b) maintaining the reaction zone under the said temperature and pressure conditions in the absence of externally added hydrogen, for a time sufficient to produce a residue and a vapor phase comprising light hydrocarbons, gaseous product and water;

(c) withdrawing the residue and said phase from the second zone;

(d) separating said phase into a gaseous product, a liquid comprising water and light hydrocarbon product having an API gravity at 25° C. of between about 20 and 40 and substantially free of vanadium and nickel values; and (e) recovering said light hydrocarbon product.

The present invention still further provides a catalytic process for converting heavy hydrocarbons into light hydrocarbons which comprises:

(a) contacting, in a reaction zone, heavy hydrocarbons having an API gravity at 25° C. of less than about 20 and a total vanadium and nickel content of between about 100 and about 1000 ppm with a liquid comprising water and with an effective amount of a catalytic material comprising at least one member selected from the group consisting of phenanthrene, ammonium carbonate, formic acid, rhodium metal on alumina, mixtures of copper and zinc metals on alumina, and oxides, sulfides, sulfates, or halides of antimony, calcium, iron, tin or zinc, in the absence of externally added hydrogen, at a temperature greater than about 340° C. and 480° C. and at a pressure between about 1350 kPa (about 196 psig, about 13.2 atm) and about 15,000 kPa (about 2175 psig, about 148 atm);

(b) maintaining the reaction zone under said temperature and pressure conditions, in the absence of externally added hydrogen, for a time sufficient to produce a residue and a vapor phase comprising light hydrocarbons, gaseous product and water;

(c) withdrawing the residue and said phase from the reaction zone;

(d) separating said phase into a gaseous product, a liquid comprising water and light hydrocarbon product having an API gravity at 25° C. of between about 20 and 40 and substantially free of vanadium and nickel values; and (e) recovering said light hydrocarbon product.

DETAILED DESCRIPTION OF THE INVENTION AND OF THE PREFERRED EMBODIMENTS

Figure 1:
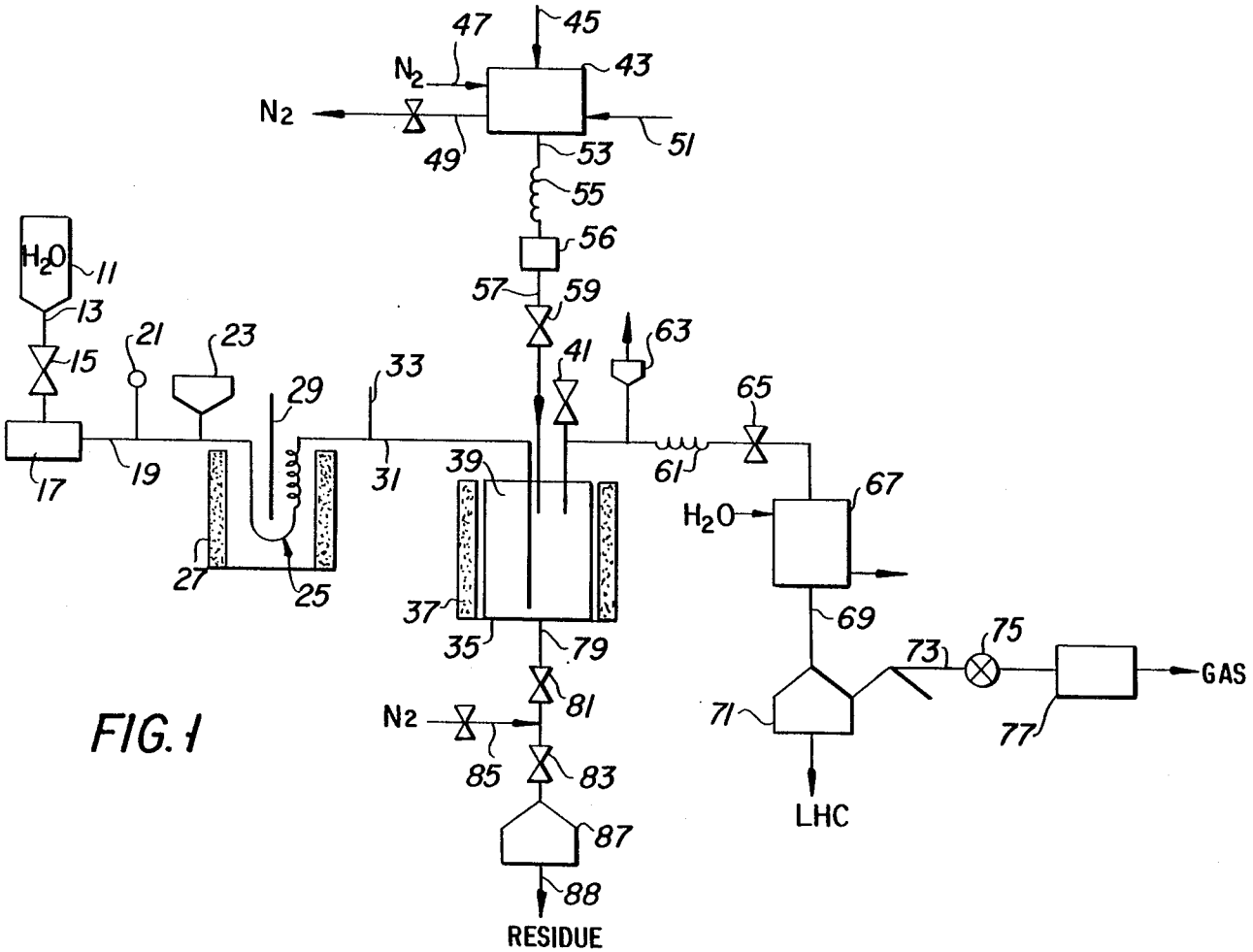
FIG. 1 is a schematic of a preferred embodiment of the process of the present invention operated in a semi-continuous reactor.

In accordance with the present invention, heavy hydrocarbons having an API gravity at 25° C. of less than about 20 are treated with water and an effective amount of at least one of selected catalytic materials such as iron oxides, sulfides or sulfates under elevated temperature and pressures, in the absence of externally added hydrogen, to produce a light hydrocarbon product having an API gravity at 25° C. of greater than about 20 and substantially free of vanadium and nickel values. Compared to the process disclosed by us in pending U.S. patent application Ser. No. 517,311, filed July 26, 1983 and relating to treatment of heavy hydrocarbons with water in the absence of externally added catalyst (as well as hydrogen), the present catalyst process provides increased amounts of light hydrocarbon product and decreased amounts of gaseous products under equivalent temperature and pressure conditions. In a preferred embodiment of the present invention, increased amounts of light hydrocarbon products were obtained from treatment of Boscan Heavy Oil with water at pressures as low as 200–500 psig at 440° C. in the presence of an effective amount, e.g., 0.3% of iron oxides or iron sulfides, e.g., iron pyrite compared to treatment of Boscan Heavy Oil with water in the absence of externally added catalyst as previously disclosed in co-pending U.S. patent application Ser. No. 517,311, filed July 26, 1983. The light hydrocarbon product, substantially free of vanadium and nickel values, has a carbon number distribution similar to that of gasoline, kerosene and diesel oil and as such can be catalytically hydrotreated at low catalyst consumption rates, into kerosene, diesel oil and gasoline, compared to heavy hydrocarbon feedstocks. By the term "substantially free of vanadium and nickel values" is meant a light hydrocarbon product containing generally less than about 50 ppm of vanadium and nickel values and as such suitable for catalytic reforming, at low catalyst consumption rates, compared to heavy hydrocarbon feedstocks. Surprisingly, it was discovered that the concentration of the vanadium and nickel in, and the values of the specific gravity and viscosity for, the light hydrocarbon product were minimized by operating within preferred the pressure and temperature range of the process of the present invention. See Tables III and IV, especially Runs #6a, 9, 10 and 13. In addition, compared to the heavy hydrocarbon feedstocks, the light hydrocarbon product has a lower specific gravity (API gravity at 25° C. greater than about 20), a lower viscosity and is usually substantially free of nitrogen and usually contains only about 75% of the sulfur contained in the heavy hydrocarbon starting material. As additional advantages of the catalytic process of the present invention, compared to the process that operation in the absence of externally added catalyst disclosed in co-pending U.S. patent application Ser. No. 517,311, filed July 26, 1983, there is produced increased amounts of light hydrocarbon product and a decreased amounts of gaseous product as well as residue (a) that may contain spent catalytic material, (b) that is usually soluble in the heavy hydrocarbon starting material, and (c) that contains no coke or pitch which would interfere with the operation of the catalytic process of the present invention. All of these advantages are achieved by the process of the present invention in the absence of externally added hydrogen.

Among the catalytic materials found useful in the process of the present invention are catalytic materials comprising at least one member selected from the group consisting of penanthrene, ammonium carbonate, formic acid, rhodium metal on alumina (which may be basic or acidic), mixtures of copper and zinc metals on alumina (which may be basic or acidic), the oxides, sulfides, sulfates, or halides of antimony, calcium, iron, tin or zinc. Solely for economic reasons, the preferred catalytic material comprises oxides, sulfides and sulfates of iron, especially iron oxides and iron sulfides in the form of iron pyrites or iron pyretite. By the term "effective amount" of catalytic material as used herein is meant at least about 0.1 to about 10 weight percent of catalytic material, preferably about 0.1 to 5, more preferably about 0.3 weight percent of the catalytic material (basis). The catalytic materials such as iron sulfates, ammonium carbonate or formic acid which are soluble in water may be added as an aqueous solution to the heavy hydrocarbon but may also be added with the water to form an aqueous solution which is then contacted with the heavy hydrocarbons. The catalytic materials such as iron oxides, iron sulfides (especially iron pyrite or iron pyretite) which are insoluble in water may be mixed with the heavy hydrocarbons to form a slurry which is thereafter contacted with the water. In the embodiment of the present invention operated in a semi-continuous mode, iron sulfates are added to water to form a dilute aqueous solution which is thereafter contacted with the heavy hydrocarbons.

In another preferred embodiment of the present invention operated in a semi-continuous mode, iron oxides or sulfides are mixed with heavy hydrocarbon to form a slurry which is thereafter contacted with water.

In still another preferred embodiment of the present invention operated in a continuous mode, a preheated uniform mixture of water and heavy hydrocarbon are contacted with a fluidized bed of the catalytic material which may conveniently be iron sulfates.

In still another preferred embodiment of the catalytic process of the present invention, the heavy hydrocarbon and water are contacted for a time sufficient to form a uniform mixture (as defined hereinbelow) and then at least one of the selected catalytic materials, in the form of a solid, slurry or aqueous solution, is added to the uniform mixture and the contacting is maintained at the temperature and pressure conditions recited hereinabove for a time sufficient to produce a residue and a vapor phase comprising light hydrocarbons, gaseous product and water. The residue and the phase are withdrawn from the zone and thereafter the phase is separated into a gaseous product, a liquid comprising water and a light hydrocarbon product having a API gravity at 25° of greater than about 20 and substantially free of vanadium and nickel values.

In another preferred embodiment of the present invention, an aqueous slurry or solution of the selected catalytic material such as oxides, sulfides and sulfates of iron, especially iron oxides or sulfides in the form of pyrites is added to the heavy hydrocarbon and a uniform mixture so formed is contacted with water preheated to the temperature and pressure conditions specified above. The contacting of the uniform mixture with the water is continued for a time sufficient to produce a residue and a phase comprising light hydrocarbons, gas and water. Thereafter, the residue and the phase are withdrawn from the reaction zone and the phase is subsequently separated into a gaseous product, a liquid comprising water and a light hydrocarbon product having a API gravity at 25° of greater than about 20 and substantially free of vanadium and nickel values.

In still another preferred embodiment of the process of the present invention which may be operated in a continuous mode, heavy hydrocarbon is contacted with a liquid comprising water in the absence of hydrogen at a temperature and a pressure recited hereinabove for a time sufficient to form a uniform reaction mixture. The uniform reaction mixture is thereafter contacted while maintaining the temperature pressure conditions recited hereinabove with at least one of the selected catalytic materials, such as rhodium metal on alumina, mixtures of copper and zinc metals on alumina, iron oxides, sulfides and/or sulfates, especially iron oxides sulfides and/or sulfates, in a form of a bed, normally a fluidized bed, in the absence of externally added hydrogen for a time sufficient to produce a residue and a vapor phase comprising light hydrocarbons, gaseous product and water. The residue is thereafter separated from the said phase and the phase is then separated into a gaseous product, liquid comprising water and light hydrocarbon product having a API gravity at 25° of greater than about 20 and substantially free of vanadium and nickel values.

The temperature of the reaction zone is between greater than about 340° and about 480° C., preferably between about 400° and about 470° C. and more preferably between about 430° and 450° C. The pressure in the reaction zone is between about 1350 kPa (about 196 psig, about 13.2 atm) and about 15,000 kPa (about 2175 psig, about 148 atm), preferably between about 1,350 kPa (about 196 psig, about 13.2 atm) and about 10,500 kPa (about 1520 psig, about 104 atm) and more preferably between about 1350 kPa (about 196 psig, about 13.2 atm) and 3500 kPa (about 507 psig, about 35 atm). For the more preferred lower range pressure, e.g. about 1350–3500 kPa, a temperature in the range of about 400° and about 460° is preferred.

It is a feature of the present invention that the range of temperature and pressure recited hereinabove is maintained in the reaction zone for a time sufficient to produce a residue and a vapor phase comprising light hydrocarbons, gaseous product and water. It is a special feature of the present invention that the separation into a residue and said phase is effected while maintaining the temperature and pressure conditions. When certain preferred catalyst materials, e.g., iron oxides, and/or iron sulfides and/or iron sulfates are used, the residue which may normally contain spent catalyst material and the phase in the form of vapors comprising light hydrocarbons, gas and water are withdrawn from the reaction zone at the temperature and pressure of the zone. In a preferred embodiment of the present invention, the vapor phase withdrawn from the reaction zone is separated into a gaseous product, a liquid comprising water and light hydrocarbon products (in the form of two separable phases), and the liquid hydrocarbon product is recovered. In another preferred embodiment of the present invention, the separation of the vapor phase into its components is effected by reducing the pressure and temperature of the reaction zone to values sufficient to allow phase separation. In another preferred embodiment of the present invention, separation of the vapor phase into its components is effected at the temperature and pressure values maintained in the reaction zone and the pressure and temperature are reduced to ambient values only after the liquid hydrocarbons are removed from the gaseous product and the liquid comprising water.

By the term "uniform mixture" as used herein, is meant an emulsion, or a solution of vapors in liquid or of vapors in vapor or liquid in liquid solid in liquid or vapor or any mixture thereof sufficient to provide intimate contacting so as to facilitate catalytic conversion of the heavy hydrocarbons into light hydrocarbon product.

By the term "phase" as used herein to describe the phase comprising the liquid hydrocarbons, gas and water that are formed and removed from the reaction zone, is meant a mixture of vapor and liquid or vapor, gas and liquid or all vapors.

By the term "effective amount of a catalytic material" as used herein is meant at least about 0.1 weight % of the catalytic material. While the upper limit of the catalytic material is not critical, conveniently no more than about 10%, preferably no more than about 5 weight % of catalytic material need be used.

Surprisingly, when the heavy hydrocarbons were treated with water at between 370° and 460° C. and at atmospheric pressure, the atmospheric steam distillation process produced only a small amount of hydrocarbon extract having a high (50–200 ppm) vanadium and nickel. When the heavy hydrocarbons such as Boscan heavy oil, shale oil or tar sand bitumen were treated in the semi-continuous reactor with water in the presence of 0.3 weight % of iron oxides at 410° C. and a pressure of 10,500 kPa (1500 psig), a higher yield of light hydrocarbons (about 72% with Boscan heavy oil) was obtained than when no externally added catalyst was present. When a heavy hydrocarbon, Boscan heavy crude oil, was treated with water at 410° C. and 440° C. in the presence of 0.3 weight % of iron oxides and iron sulfides and at a preferred lower range pressure of about 1350 kPa to 3500 kPa (196 psig to about 507 psig), a yield of light hydrocarbon product as high as 75 weight % was obtained substantially free of vanadium and nickel and having an acceptable low viscosity and density (the inversely proportional to the API gravity) compared to about a 54% yield of light hydrocarbon produced when the heavy hydrocarbon (Boscan Heavy Oil) was treated with water, in a semi-continuous reactor under the same temperature and pressure conditions in the absence of externally added catalyst. See Run #1 and 2 of Table II hereinbelow.

The water to oil volume ratio is not critical and may be varied from about 0.25:1 to about 10:1, preferably from about 0.4:1 to about 3:1 and more preferably from about 0.6:1 to about 1.5:1.

The process of the present invention operates in the absence of externally added hydrogen; only the hydrogen provided from the water in the presence of externally added catalyst is required for the process of the present invention. In some instances when continuous operation is desirable, it may be desirable to provide the reaction zone with a fluidized bed of catalytic material such as particles of iron sulfates. Inert materials such as granite, sand, porcelain or bed saddles in reaction zone may also be used but their use is not critical to operation of the present invention. In addition, it is preferable to operate the process of the present invention in an atmosphere substantially free of gases such as oxygen which may interfere with the process of the present invention. However, the presence of small amounts of air are not detrimental to the process of the present invention.

The process of the present invention operates with heavy hydrocarbons having an API gravity at 25° C. of less than about 20. Among the heavy hydrocarbons found useful in the process of the present invention are heavy crude oil, heavy hydrocarbons extracted from tar sands, commonly called tar sand bitumen, such as Athabasca tar sand bitumen obtained from Canada, heavy petroleum crude oils, such as Venezuelan Orinoco heavy oil belt crudes (Boscan heavy oil), heavy hydrocarbon fractions obtained from crude petroleum oils particularly heavy vacuum gas oils, vacuum residue as well as petroleum tar and coal tar or even shale oil. The viscosity measured at 25° C. of the heavy hydrocarbon feedstock material may vary over a wide range from about 1,000 to about 100,000 cp, normally 20,000 cp to about 65,000 cp. Shale oil, a crude dark oil obtained from oil shale by heating, has a viscosity in the range of about 100 to about 300 cp (at 25° C.) but is considered a heavy hydrocarbon feedstock for the process of the present invention. In a preferred embodiment of the present invention, Boscan heavy oil having a viscosity of about 60,000 cp at 25° C. is treated with water in the presence of iron sulfates or oxides or sulfides at 410° C. and 6,894 to 13,788 kPa (1,000 to 2,000 psig) to produce a light hydrocarbon product having a viscosity at 25° C. of less than about 10 cp. In another preferred embodiment of the present invention, tar sand bitumen having a viscosity of about 30,000 cp at 25° C. is converted by treatment with water in the presence of iron sulfates or oxides or sulfides at 410° C. and 6,894 to 13,788 kPa (1,000 to 2,000 psig) into light hydrocarbon product having a viscosity at 25° C. of less than about 10 cp. Among the organometallic compounds found in the heavy hydrocarbons, nickel and vanadium are most common although other metals including iron, copper, lead and zinc are also often present. In a preferred embodiment of the process of the present invention heavy hydrocarbons having an API gravity at 25° C. of less than about 20 and a total vanadium and nickel content between 1,000 and 2,000 ppm was converted into light hydrocarbons having an API gravity of 25° C. of between about 20 and 40 and a total vanadium and nickel content less than about 50 and preferably less than about 30 ppm. In another preferred embodiment of the present invention heavy hydrocarbons having an API gravity at 25° of less than about 20 and a total vanadium and nickel content of between about 100 and 1000 ppm were converted into light hydrocarbon product having a API density at 25° between about 20 and 40 and a total vanadium and nickel content less than about 50 ppm preferably less than about 30 ppm.

By the term "light hydrocarbon product" as used herein is meant a hydrocarbon having an API gravity at 25° C. of greater than about 20 preferably between about 20 and about 40. The light hydrocarbon product obtained in accordance with the process of the present invention has a total vanadium and nickel content generally of less than about 50 ppm, preferably less than about 30 ppm, and is usually substantially free of organonitrogen compounds and usually contains only about 75% of the organosulfur compounds present in the starting heavy hydrocarbons. The viscosity of the light hydrocarbon product at 25° C. is less than about 10 cp, preferably less than about 5 cp. The hydrogen to carbon ratio of the light hydrocarbon is higher than the hydrogen to carbon ratio of the heavy hydrocarbons. In a preferred embodiment of the present invention, the heavy hydrocarbon, Boscan heavy oil having a hydrogen-carbon ratio equal to about 1.5 was treated with water at 410° C. and 10,342 kPa (1500 psig) to produce a light hydrocarbon product having a hydrogen-carbon ratio of about 1.7. By gas chromatographic analysis, the weight distribution of carbon units in the light hydrocarbon product having the H/C ratio of 1.7 was approximately the same as that found in gasoline, kerosene and diesel oil.

The gaseous product obtained by treatment of the heavy hydrocarbons in accordance with the process of the present invention comprises carbon dioxide, hydrogen sulfide and $C_1$–$C_6$ alkenes and alkanes as well as a trace amount of hydrogen. The amount of the gaseous product obtained is preferably no more than about 10 weight %, and preferably is less than about 5 weight % and even 1–2 or less weight %, basis starting heavy hydrocarbons.

The residue obtained by treatment of the heavy hydrocarbons in accordance with the process of the present invention is usually soluble in the feedstock heavy hydrocarbons. This residue is not a coke or pitch and as such may be used as a source of fuel, may be recycled or may be treated with steam or lower hydrocarbons such as pentane to remove light hydrocarbons that may be entrapped therein.

The fluid comprising water may be tap water, river water, lake water or the like and may contain small amounts of salts accompanying the crude oil as obtained from the ground. While the presence of salt in the water may be tolerated, a salt concentration of greater than about 100 ppm is objectionable and is to be avoided.

The process of the present invention may be carried out either as a semi-continuous or batch process or as a continuous process. In the continuous process both the heavy hydrocarbons and water are fed under pressure to a preheated first part of the reaction zone wherein the temperature and pressure conditions are maintained for a time sufficient to form a uniform mixture which is forwarded to the second part of the reaction zone conveniently containing at least an effective amount of at least one of the selected catalyst materials which may conveniently be a fluidized bed wherein the temperature and pressure conditions are maintained for a time sufficient to separate the uniform mixture into a residue and a phase containing the light hydrocarbon and gaseous products; the phase is continuously removed from the second part of the reaction zone while the residue stream is continuously or periodically removed. The residence time in the first and second parts of the reaction zone may be varied from a few minutes up to about 20 minutes, depending upon characteristics of heavy hydrocarbon feedstock and light hydrocarbon product desired. In the batch process a total residence time of about 10–20 minutes, preferably about 10 minutes, is used. In the continuous process, a total residence time of a few seconds to 20 minutes, preferably about 10 seconds to less than about 5 minutes is used. In a continuous process, less gas is obtained than in the semi-continuous or batch process; less than about 10 weight %, preferably less than about 5 weight % and usually less than about 1–2 weight % of the total products are produced as gas in the continuous process.

A preferred embodiment of the reaction of the present invention practiced in a semicontinuous flow reactor is illustrated in FIG. 1. Water in storage vessel 11 is passed via line 13 through valve 15 to high pressure piston pump 17 through line 19 containing check valve 21 and pressure transducer 23 fed to a spiral or tubular heater 25 immersed in the fluidized sand bath 27 equipped with thermocouple 29. The residence time in the heater 25 is preferably less than about 1 minute, more preferably on the order of about 10 seconds. The water is passed via line 31 containing thermocouple 33 to high pressure autoclave 35 equipped with heating jacket 37, thermocouple 39 and safety valve 41. Storage vessel 43 equipped with heavy hydrocarbon feed line 45, catalyst feed line 51 and pressurized with nitrogen via line 47 and a safety valve in line 49 is passed via line 53 equipped with heating tape 55 to high pressure gear pump 56 and then through line 57 containing containing check valve 59. In order to promote intimate contact between the heavy hydrocarbon, catalyst material and the water, the water from line 19 and the heated heavy hydrocarbon and the aqueous solution of catalyst in line 57, may be are continuously fed through valve 20 (not shown) in line 57 which may be equipped with a spiral stirrer to produce small droplets on the order of submicrons to about several microns of the aqueous catalyst in the heavy hydrocarbon. The residence time in the high pressure autoclave 35 is from a few seconds up to about 20 minutes. The light hydrocarbon stream and the gaseous stream produced from the intimate contact in high pressure autoclave 35 are continuously removed via line 61 containing pressure transducer 63, air operated pressure control valve 65 to condenser 67 which may be of any convenient design. From condenser 67, the light hydrocarbon and the gaseous streams are passed via line 69 to product receiver 71 for separation of the light hydrocarbon stream from the gaseous stream. The gaseous stream is removed via line 73 containing volumetric flowmeter 75 to gas storage container 77. The light hydrocarbon stream is removed from receiver 71 via line 72. Residue, which may contain some spent catalyst and, in some instances, even some light hydrocarbons, is periodically removed via line 79 containing valves 81 and 83 and equipped with nitrogen line 85 and forwarded to residue container 87.

It is a special feature of the process of the present invention that the residue containing some spent catalyst is separated from the vapor phase comprising light hydrocarbons, gaseous product, and water while still maintaining the original pressure and temperature conditions; the residue and vapor phase are withdrawn from the reaction zone and thereafter the pressure and temperature were reduced to values sufficient to allow recovery of the residue and separation of the vapor phase into a gaseous product, a liquid comprising water and a light hydrocarbon product having the desired properties.

By maintaining the pressure and temperature conditions in the reaction zone for a time sufficient to effect separation and withdrawl of the residue and vaporous mixture, the residue is obtained substantially free of coke which would interfere with operation of the process of the present invention. In comparative example, Boscan heavy oil was continuously treated with water at 465°–470° C. and 2000 psig in a heating coil similar to that of U.S. Pat. No. 2,135,332 at varying residence times and the pressure and temperature reduced to ambient to form a reaction mixture which was thereafter distilled under vacuum to recover light hydrocarbon product. However, when the residence time was increased to provide greater than 50% up to 76% by weight of light hydrocarbons product, the heating coil became plugged with coke and the reaction was terminated.

Figure 2:
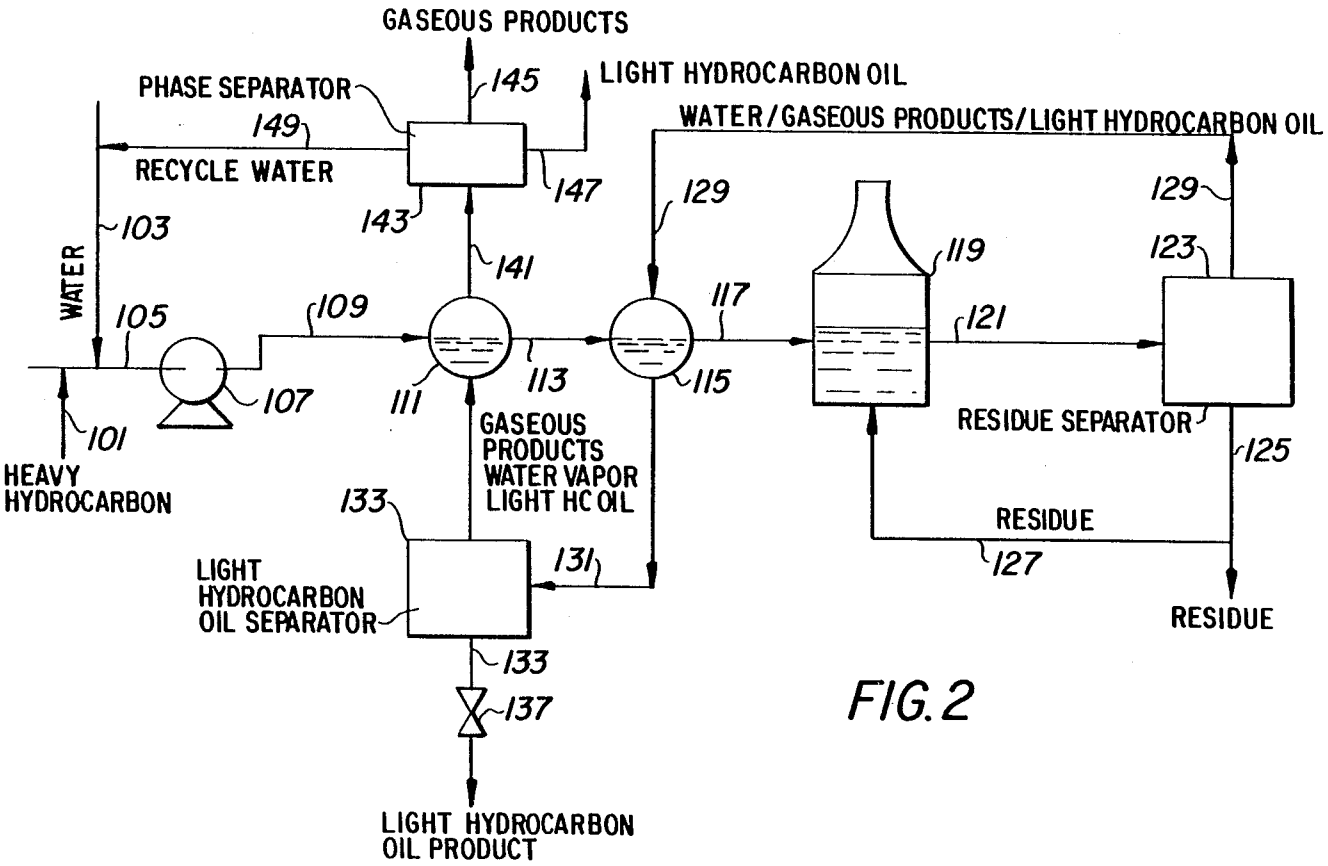
FIG. 2 is a schematic of another preferred embodiment of the process of the present invention operated in a flow reactor.

FIG. 2 illustrates a schematic of a flow reactor for continuous operation of another preferred embodiment of the present invention. A heavy hydrocarbon feedstock, such as heavy crude oil in line (or stream) 101 is premixed with water in line 103 and the mixture is fed via line 105 to pump 107 which pumps mixture via lines 109 and 113 to high pressure heat exchangers 111 and 115 which may be of any convenient design and then via line 117 to high temperature preheater 119 containing a catalytic bed, e.g., a fluidized bed of iron sulfates. Preheater 119 may conveniently be a high pressure direct-fired tubular heater. The reaction mixture from preheater 119 is passed via line 121 to residue separation unit 123. In separation unit 123, the reaction mixture is separated into a vapor stream 129 suitable for further processing and/or transportation, and containing (1) $C_1$–$C_6$ alkanes and alkenes, hydrogen sulfide, carbon dioxide and trace amounts of hydrogen, (2) light hydrocarbons, and (3) water vapor, and a residue stream 125 which may contain some catalytic material and even in some instances, some light hydrocarbons and which may be used as fuel or at least partially recycled via line 127 to preheater 119. The gaseous stream 129 is passed through heat exchanger 115 in line 131 to light oil separator 133 wherein the light oil is removed via line 135 containing pressure let-down valve 137. The pressure let-down valve 137 may also be positioned in line 131. The gaseous alkanes, alkenes, carbon dioxide, hydrogen and water vapor removed from light oil in separator 133 via line 139 pass through heat exchanger 111 and line 141 to phase separator 143. Gases are removed from 143 via line 145. Light oil which may be present is removed via line 147. Water removed from phase separator 143 via line 149 is forwarded to water make-up line 103. The design of the separation units 123, 133 and 143 will depend on the types of heavy hydrocarbon feedstock and of catalytic material used, the degree of restructuring desired, and other economic factors.

The first and second parts of zones for operating the semi continuous and continuous modes of the process of the present invention may be separate reactors (as in FIG. 2) or two reaction zones within the same reactor. The reaction conditions, e.g., temperature and pressure, water:oil ratios chosen will, of course, depend on many considerations such as the heavy hydrocarbon feedstock available and the light hydrocarbon product desired.

The following examples illustrate the present invention and are not intended to limit the same.

GENERAL EXPERIMENTAL

Description-Batch Reactor. Water was fed from a graduated cylinder to a high pressure pump (Aminco, cat. no. 46-14025) provided with a pressure gauge. Water was delivered at a uniform rate through a preheater coil heated to 410° C. by a Lindbergh electric oven into a 300 $cm^3$ stirred autoclave (from Autoclave Engineering). A special "gaspersator" magnet drive stirrer was used with a water cooling at the top. A thermocouple measured the extraction temperature while the autoclave was heated by a heating jacket controlled independently. The tubing between preheater and autoclave and release valve was heated with heating tapes controlled by a Variac variable poteniometer. A special high temperature, high pressure let down valve was used at exit. The valve was sensitive to plugging. The plugging problem was eliminated by releasing steam occasionally through the valve. A mixture of steam and light hydrocarbon was passed through a water-cooled condenser and collected in the receiver. The uncondensed material went through a buffer container, suitable for gas sampling and was collected in a collapsible balloon. The complete batch reactor was placed in an explosion proof high pressure laboratory cubicle and was operated from outside. The high pressure, high temperature batch experiments with heavy crude oil and tar sand bitumen were performed in this way.

Analysis of Extract, Gases and Residue. The graphite furnace method was used to determine the amount of vanadium and nickel in the light hydrocarbon stream, and atomic absorption method used for the residue. Viscosity was recorded either by New Metrec or Cannon Ubhelode instrument. Density measurement was made by a pyconometer. $^1H$ and $^{13}C$ nmr spectra were recorded in deuterochloroform. For $^1H$ nmr Varian XL200 and for $^{13}C$ nmr Varian FT 80A instruments were used. Tris(acetonylacetyl)chromium [$Cr(acac)_3$] was used to allow complete relaxation of the nuclei. Electron spin resonance spectra of flowable hydrocarbons were obtained using dual cavity Varian E-12. Infrared measurement of light hydrocarbons was made in solution ($CHCl_3$) with a Perkin-Elmer 239 Infrared Spectrophotometer, and of residue was made with a Nicolet 7199 FT-IR spectrophotometer. Thermogravimetric analysis (TGA) of residue was performed by Dupont 951-TGA instrument.

Molecular weight distributions of the light hydrocarbons products and the heavy hydrocarbon feed samples were determined by Gel Permeation Chromatographic techniques. The samples were dissolved in THF and eluted through $\mu$-styrogel column at ambient temperature. A differential refractometer ($\Delta$RI) was used to detect the eluting species. The molecular weight distribution (highest, peak and lowest) were obtained from retention volume. Linear aliphatic hydrocarbon standards were used for distribution of molecular weight calibration of the $\mu$-styrogel column.

Boscan heavy crude oil, tar sand bitumen and the light hydrocarbons produced therefrom and some standards (gasoline, kerosene and diesel) were analyzed by Hewlett-Packard Model No. 5880 gas chromatograph equipped with a flame ionization detector and a capillary splitter.

The range of separation for aliphatics, using a capillary gas chromatograph described above, was $C_1$ to $C_{30}$ hydrocarbons. The aromatic range was benzene to benzo(a)pyrene. Identification of peaks was achieved by comparison with standards representative of each chemical class.

A class separation into aliphatics, aromatics and polars was performed by high pressure liquid chromatography (Varian 500 HPLC equipped with an LDC Spectro Monitor III variable wavelength detector and a Valco ULCI automatic sample injector with 10 and 250 $\mu$L sampling loops). Using a 5 $\mu$m cyano bonded stationary phase (Zorban CN 4.6×250 mm from Dupont) and employing the following gradient: isocratic elution with hexane for 3 min followed by a 0–100% 1-butanol gradient in 5 min at a flow of 1 mL/min. Absorbence was measured at 254 nm. Aliphatic (alkane/alkene) fractions will not exhibit UV absorbence at 254 nm but will elute prior to the aromatic fraction. Preparative HPLC was carried out with a 9.4×250 mm, 5$\mu$ Zorbax CN semi-preparative column. In semi-preparative separation solvent flow was 5 mL/min and detection was made at 320 nm. As much as 30 mg filtered light hydrocarbon stream in hexane could be loaded on the column. The samples were filtered using a 0.45$\mu$ to remove insoluble material. Fractions obtained were further analyzed by FID capillary gas chromatography.

Separation of gases was achieved with a gas chromatograph equipped with a gas injector and TC detector using oxidized Porapak Q (⅛"×3') or 20% dimethylsulfolane on 80/100 chromosorb P (⅛"×20'; at −25° C.). GC/MS of gas samples were obtained on Finnigan 3300 (electron impact) using INCOS DATA system.

COMPARATIVE EXAMPLES 1–2

Treatment of Bitumen and Boscan Heavy Oil with Water in the Presence of and in the Absence of Iron Oxides. Athabasca tar sand bitumen (a sample substantially free of sand, supplied by Alberta Research Council) and Boscan heavy crude oil from Venezuela were used in Example 1 (Runs #1–2 and in Example 2 (Runs #3 and 4), respectively. In Runs #1 and 3 60 g of heavy oil or bitumen were charged in a heated (450° C.) autoclave described in General Experimental purged with nitrogen gas. In Runs #2 and 4, a mixture of 60 g of heavy oil or bitumen and an aqueous solution of 0.3 weight % (basis total mixture) $Fe_2O_3$ was changed into preheated (450° C.) autoclave. In all the runs, the material was heated to 410° C. usually in 10–15 minutes. During the heating period, some water was added to develop the desired pressure. Once an appropriate pressure and temperature were attained, the compressed steam at same temperature was passed at a set flow rate. The pressure was maintained by controlling the let-down valve manually. A total of 200 mL water was used for the reaction. The amount of water used to develop the desired pressure varied from 12 mL to 50 mL. The extract and the condensed steam were collected in a three neck flask. Most of the light hydrocarbon was separated from the condensed steam by a separatory funnel after allowing enough time for phase separation. The remaining light hydrocarbon and condensed steam were diluted with pentane or fluorotrichloromethane and separated in a separatory funnel. Following drying over $MgSO_4$ and filtration, solvent was distilled off using a water bath at controlled temperature. The material left in the autoclave was defined as residue. The results of treatment of Boscan heavy crude oil and of tar sand bitumen with water at 410° C. and various pressures are reported in Tables I and II, respectively.

TABLE I

Effect cf Iron Catalyst on Treatment of Boscan Heavy Oil, Shale Oil and Athabasca Tar Sand Bitumen with Water at 410° C. and 1500 psig

| Run # | HHC | Catalyst | Yield Data (wgt %) Light HC | Gas | Residue |
|---|---|---|---|---|---|
| 1 | BHO[1] | none | 59 | 5 | 36 |
| 2 | " | 0.3% $Fe_2O_3$ | 78 | 4 | 18 |
| 3 | TSB[2] | none | 78 | 0.5 | 21.5 |

TABLE I-continued

Effect cf Iron Catalyst on Treatment of Boscan Heavy Oil, Shale Oil and Athabasca Tar Sand Bitumen with Water at 410° C. and 1500 psig

| Run # | HHC | Catalyst | Yield Data (wgt %) Light HC | Gas | Residue |
|---|---|---|---|---|---|
| 4 | " | 0.3% $Fe_2O_3$ | 85 | 0.6 | 14.5 |

[1]Boscan Heavy Oil
[2]Athabasca Tar Sand Bitumen

TABLE II

Comparison of Properties of Boscan Heavy Oil, and the Light Hydrocarbons and Residue Obtained Therefrom by Treating Boscan Heavy Oil at 410° C. at 1500 psig

| Property | Boscan Heavy Oil | Run #1 No Catalyst* Light HC | Residue | Run #2 0.3% $Fe_2O_3$** Light HC | Residue |
|---|---|---|---|---|---|
| API Gravity | 10.3 | 32.1 | — | 29.5 | — |
| Viscosity C.P. (Temp) | 60,600 (37° C.) | 2.49 (25° C.) | — | 4.68 | — |
| C wt % | 81.84 | 82.59 | 85.15 | 83.38 | 85.15 |
| H | 10.41 | 11.39 | 4.25 | 11.57 | 4.25 |
| N | 0.56 | Trace | 1.53 | Trace | 1.53 |
| S | 5.52 | 3.99 | 6.61 | 4.22 | 6.38 |
| O | 1.25 | 0.35 | 0.92 | 0.295 | 0.878 |
| H/C Ratio | 1.51 | 1.64 | 0.65 | 1.69 | 0.59 |
| V wt ppm | 1500 | 3 | 5900 | 7.2 | 5900 |
| Ni wt ppm | 100 | 1 | 600 | 0.68 | 600 |
| Aromatic C % | 17.9 | 20.6 | — | 20.1 | — |
| Pentane Soluble % | 78 | 100 | none | 100 | none |
| Toluene Soluble % | 100 | 100 | 1 | 100 | 1 |
| THF Soluble % | 100 | 100 | 4 | 100 | 4 |

Comparison of Properties of Tar Sand Bitumen, and of the Light Hydrocarbons and Residue Obtained Therefrom by Treatment with $H_2O$ at 410° 1500 psigs

| Property | Bitumen | Run #3** No Catalyst Light HC | Residue | Run #4*** 0.3% $Fe_2O_3$ Light HC[a] | Residue[a] |
|---|---|---|---|---|---|
| API Gravity (25° C.) | 10.14 | 23.16 | — | | |
| Viscosity cp (25° C.) | 28,000 | 7.5 | — | | |
| C wt % | 83.21 | 83.42 | 80.84 | | |
| H | 10.44 | 10.75 | 4.24 | | |
| N | 0.76 | Trace | 1.61 | | |
| S | 4.77 | 3.51 | 6.50 | | |
| O | 1.2 | 1.18 | 2.5 | | |
| H/C Ratio | 1.49 | 1.53 | 0.62 | | |
| V wt ppm | 150 | 22 | 730 | | |
| Ni wt ppm | 55 | 9 | 520 | | |
| Pentane Soluble % | 72 | 72 | None | | |
| Toluene Soluble % | 100 | 100 | 16 | | |
| THF Soluble % | 100 | 100 | 30 | | |

*yield data for Run #1 (wgt %): 59% Light HC; 5% Gas; 36% Residue
Please provide properties of light oil produced in Table I
**yield dat for Run #2 (wgt %): 78% Light HC; 4% Gas; 18% Residue
***yield data for Run #5 (wgt %): 78% Light HC; 0.5% Gas; 21.5% Residue
[a]Similar results to those obtained in Run #2 are expected
****yield data for Run #6 (wgt %): 85% Light HC; 0.6% Gas; 14.0% Residue

COMPARATIVE EXAMPLE 3

This comparative example (Runs #5–14) illustrates the effect of the presence and absence of iron oxides ($Fe_2O_3$) and pyrite on treatment of 60 g of Boscan Heavy Oil with 200 ml of water for 20 minutes. The apparatus of FIG. 1 and procedure of Examples 1 and 2 were followed except that the temperature and pressure were varied as summarized in Tables III and IV.

TABLE III

Effect of Presence of $Fe_2O_3$ and Pyrite on Treatment of Boscan Heavy Oil with Water at Various Temperatures and Pressures

| Run # | Condition* | Yield Light HC | Data Gas | (weight %) Residue |
|---|---|---|---|---|
| 5 | No catalyst/[1] 410° C./1500 psig | 59 | 5 | 36[3] |
| 6a | Run #5[2,3] + 0.3% $Fe_2O_3$ | 77.5 | 4 | 18.5 |
| 6b | Run #5[2,3] + 3% $Fe_2O_3$ | 77.5 | 4 | 18.5 |
| 7 | 0.3% $Fe_2O_3$ 340° C./1500 psig | 27 | trace | 73 |
| 8 | No Catalyst/[1] 410° C./500 psig | 55 | 2.5 | 42.5 |
| 9 | Run #8 + 0.3% $Fe_2O_3$ | 67.3 | 1.2 | 31.5 |
| 10 | 0.3% $Fe_2O_3$/440° C. /500 psig | 77.4 | 3.2 | 19.4 |
| 11 | 0.3% Pyrite/440° C. /500 psig | 75.5 | 3.0 | 21.5 |
| 12 | No Catalyst/[1] /440° C./200 psig | 65 | 3.4 | 31.5 |
| 13 | Run #12 + 0.3% $Fe_2O_3$ | 76.3 | 1.8 | 21.9 |

TABLE III-continued

Effect of Presence of $Fe_2O_3$ and Pyrite on Treatment of Boscan Heavy Oil with Water at Various Temperatures and Pressures

| Run # | Condition* | Yield Light HC | Data Gas | (weight %) Residue |
|---|---|---|---|---|
| 14 | Run #12 + 0.3% Pyrite | 76 | 1.5 | 22.5 |

Notes To Table III

[1]No externally added catalyst was added

[2]Conditions of Run #5 were used but 0.3% weight of $Fe_2O_3$ was added to Boscan Heavy Oil

[3]% residue recovered is measure of % conversion of Boscan Heavy Crude Oil: for example, in Run #5, a yield of 36% residue corresponds to 64% conversion

TABLE IV

Properties of Light Hydrocarbon Products Recovered From Treatment of Boscan Heavy Oil Without and Without Added Catalyst as Shown in Table III

| Property | Run #: 5 | 6a | 6b | 7 | 8 | 9 | 10 | 11 | 12 | 13 | 14 |
|---|---|---|---|---|---|---|---|---|---|---|---|
| V(ppm) | 4.2 | 7.3 | 3.1 | — | 20 | 17.1 | 13.80 | 24.2 | — | 36.6 | — |
| N1(ppm) | 1.0 | 0.62 | .27 | — | 5 | 1.06 | 1.02 | 1.4 | — | 2.13 | — |
| Viscosity at 25° C. (cp) | 2.49 | 4.68 | 2.54 | — | 7.6 | 9.32 | 6.57 | 5.74 | — | 9.67 | 12.7 |
| API Gravity | 32 | 29.5 | 32.4 | — | 27 | 27.5 | 28.5 | 28.5 | — | 26.6 | 26.1 |
| H/C Ratio | 1.65 | 1.69 | 1.68 | — | — | 1.71 | — | — | — | 1.70 | — |
| Normal C | 17.8 | 22.2 | 22.7 | — | — | — | — | — | — | — | — |

EXAMPLE 4

This Example illustrates the effect of various additives or catalytic materials on the treatment of Boscan Heavy Oil with water at 410° C. and 1500 psig in the apparatus of FIG. 1 in accordance with the procedure of Example 1. In each of runs except Run #26 60 g of Boscan Heavy Oil was mixed with catalyst and treated with 200 ml of water for 20 minutes at 410° C. and 1500 psig. The results are summarized in Table V.

TABLE V

Effect of Various Additives on Treatment of Boscan Heavy Oil with Water at 410° C. and 1500 psig

| | Run #: 15 | 16 | 17 | 18 | 19 | 20 | 21 | 22 |
|---|---|---|---|---|---|---|---|---|
| Additive (wt %) | None | 0.5% $Sb_2O_3$ | 0.5% $SnCl_2$ | 1% $HCO_2H$ | 6.6% S | $Cu_3Zn/Al_2O_3$[4] (0.5%) | $Rh/Al_2O_3$[4] (0.5%) | $Al_2O_3$[5] (0.5%) |
| Yield Data[1,2] | | | | | | | | |
| Light HC | 59 | 66 | 61.5 | 64.3 | 63[3] | 66 | 65.6 | 64.5 |
| Gas | 5 | 7 | 7.5 | 14.5 | 5.0 | 9 | 7.0 | 6.5 |
| Residue | 36 | 27 | 31 | 21.2 | 32 | 25 | 27.4 | 29 |
| Properties of Light HC | | | | | | | | |
| V (ppm) | 4.2 | 2.6 | 3.95 | 6.8 | 2.38 | 0.33 | 6.1 | 4.2 |
| Ni (ppm) | 1.0 | 0.22 | 0.39 | 0.5 | 0.14 | .065 | 0.6 | 0.68 |
| Viscosity (cp) at 25° C. | 2.44 | 3.8 | 3.51 | 3.4 | 3.31 | 2.0 | 2.99 | 3.03 |
| API Gravity (at 25° C.) | 32 | 32.5 | 32.0 | 31.0 | 30.7 | 35.5 | 30.7 | 31.2 |
| H/C Ratio | 1.65 | 1.68 | 1.69 | 1.65 | — | 1.67 | 1.67 | 1.69 |
| Normal Carbon (%) | 17.8 | 20.9 | 18.16 | — | 20.3 | 18.97 | 21.32 | 21.63 |

| | Run # 23 | 24 | 25 | 26 | 27 |
|---|---|---|---|---|---|
| Additive (wt %) | $ZnCl_2$ (0.3%) | $CaCl_2$ (1%) | Phenan (3%) | $(NH_4)_2CO_3$[7] (5%) | i-$C_3H_7OH$[8] (20%) |
| Yield Data[1] | | | | | |
| Light HC[2] | 66.2 | 72.5 | 73.5 | 69.5 | 65.5 |
| Gas | 6.8 | 3 | 2 | 5 | 5.4 |
| Residue | 27 | 24.5 | 24.5 | 25.5 | 29.3 |
| Properties of Light HC | | | | | |
| V (ppm) | 4.5 | —[6] | 7.9 | 4.2 | —[6] |

TABLE V-continued

| Effect of Various Additives on Treatment of Boscan Heavy Oil with Water at 410° C. and 1500 psig | | | | | |
|---|---|---|---|---|---|
| Ni (ppm) | 0.56 | — | 0.73 | 1.0 | — |
| Viscosity (cp) at 25° C. | 2.99 | — | 4.45 | 2.49 | — |
| API Gravity (at 25° C.) | 31.2 | — | 29.1 | 32 | — |
| H/C Ratio | 1.68 | — | 1.70 | 1.65 | — |
| Normal Carbon (%) | 22.4 | — | 20.26 | 17.8 | — |

Footnotes to Table V

[1]Weight percent; % residue calculated from % conversion.

[2]Boscan Heavy oil continued 5.55 weight percent of sulfur. The light hydrocarbon product contained from 3.8 to 4.1 weight % of sulfur.

[3]The sulfur content of light hydrocarbon product was not measured.

[4, 5]gamma alumina

[6]Properties of Light HC were not measured but are expected to be similar to those for other Light HC products reported in this Table.

[7]$(NH_4)_2CO_3$ was mixed with 200 mL of water to form an aqueous solution which was thereafter contacted with 60 g of Buscan Heavy oil.

[8]Isopropanol (40 ml) was the catalyst mixed with 200 ml water to form a mixture (20 weight % in isopropanol) that was thereafter contacted with 60 g of Buscan Heavy oil. In a similar run with 10 weight % methanol in water, the following yield data was obtained: 70% light HC; 4.5% gas and 25.5% residue; similar results were obtained with 30 wgt % methanol. As the weight % of methanol was increased, yield of gas (due to decomposition of methanol) increased and the yield of light HC decreased at 100% methanol (no water), yield of light HC was 45% and 50% of the methanol had decomposed.

EXAMPLES 5–9

Figure 3:
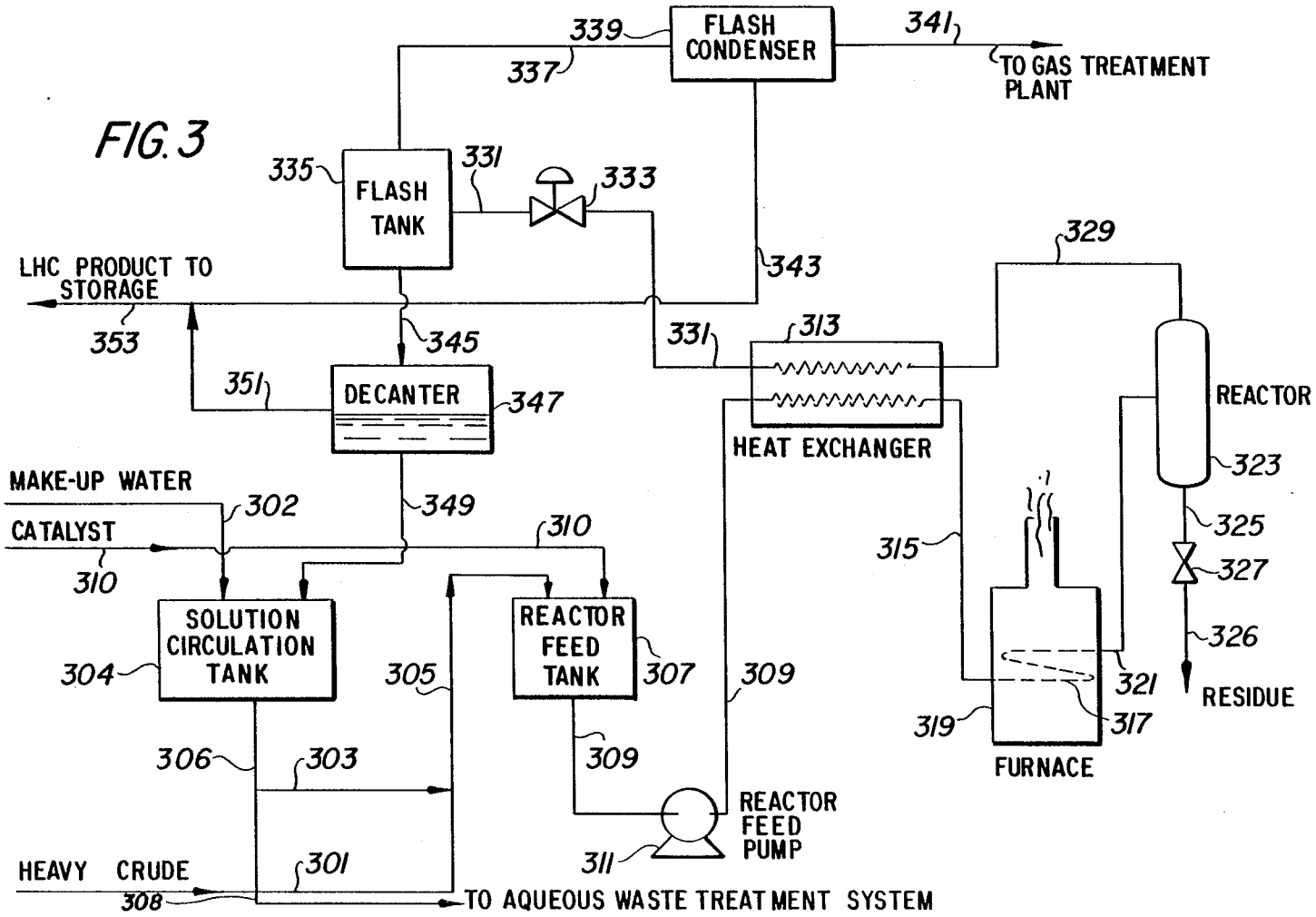
FIG. 3 is a schematic of an alternative preferred embodiment of the process of the present invention operated in a flow reactor.

The following Examples (5–9) describe an alternative preferred embodiment for continuous operation of the present invention in flow reactor illustrated in FIG. 3. A heavy hydrocarbon feedstock, such as Boscan heavy crude oil in stream 301 is mixed with water from stream 303 and the mixture is fed via stream 305 to reactor feed tank 307. Catalyst in stream 310 is fed to reactor feed tank 307. The catalyst material may be any of those described hereinabove so as to form slurry or solution mixture in the water and/or heavy oil feedstock in 307. The mixture intank 307 is removed therefrom via stream 309 equipped with pump 311 which pumps mixture in stream 309 to high pressure heat exchange 313 which may be of any convenient design and then via stream 315 to high temperature preheater furnace 319 containing reaction zone 317. Preheater furnace 319 may conveniently be a high pressure direct-fired tubular heater. The reaction mixture from preheater 319 is passed via stream 321 to reactor 323. In reactor 323, the reaction mixture is separated into a vapor stream 329 suitable for further processing alkanes and alkenes, and/or transportation, and containing (1) $C_1$–$C_6$ hydrogen sulfide, carbon dioxide and trace amounts of hydrogen, (2) light hydrocarbons, and (3) water vapor, and a residue stream 325 equipped with pressure let-down valve 327. Residue stream 325 may contain some catalytic material and may be used as fuel or at least partially recycled via stream 326 to preheater 319. The vapor stream 329 is passed through heat exchanger 313 to stream 331 containing pressure let-down valve 333 to flash tank 335 wherein the mixture of light hydrocarbon oil and gases are removed via stream 337 to flash condenser 339 for separation of the mixture into a gaseous stream 341 which may be removed for further processing in, for example, a gas treatment plant and light hydrocarbons which are removed therefrom via stream 343. Water vapor in stream 331 is at least partially separated from the mixture of light hydrocarbon oil and gases in flash tank 335 and is removed therefrom via stream 343 to decanter 347 wherein residual light hydrocarbons are removed via stream 351 and combined with stream 343 to form light hydrocarbon product stream 353. The light hydrocarbon stream 353 may be forwarded for further treatment. The water in decanter 347 is removed via stream 349 to solution circulation tank 304 equpped with make-up water stream 302. Water from tank 304 is removed via stream 306 and at least a portion thereof is used as feed into stream 303 and the remainder is forwarded as stream 308 for water treatment. In Examples 5–9 the temperatures and pressures of the streams of interest are maintained as shown in Table VI.

TABLE VI

| Stream # | T (°C.) | P (psia) |
|---|---|---|
| 301 | 65 | atm[1] |
| 302 | 15 | " |
| 303 | 55 | " |
| 308 | 70 | " |
| 309 | 150 | 1800[2] |
| 321 | 410 | 1800[2] |
| 326 | 400 | atm[1] |
| 329 | 370 | 1700[3] |
| 341 | 60 | atm[1] |
| 349 | 60 | " |
| 353 | 60 | " |

[1]atmospheric pressure
[2]12,400 kPa
11,700 kPa

The mass flow (mass/hr) for streams in FIG. 3 is given in Tables VII–XI below which are provided to help clarify the operation of Examples 5–9 in process shown in FIG. 3 and does not necessarily reflect optimum or realizable conditions for the operation of the process of the present invention.

EXAMPLE 5

Example 5 illustrates continuous operation of the process in flow reactor of FIG. 3 for treatment of 10,000 barrels/day feed of Boscan heavy oil with water in the absence of externally added catalyst and hydrogen. Material balance is provided in Table VII.

TABLE VII

Material Balance[3] for Treatment of Boscan Heavy Oil with Water (no externally added catalyst) at 410° C. and 1800 psig

| | Stream: | | | | | | | | | |
|---|---|---|---|---|---|---|---|---|---|---|
| Components | 301 | 302 | 303 | 308 | 309 | 325 | 329 | 341 | 349 | 353 |
| Heavy[1] HC | 131977 | | | | 131977 | | | | | |
| Water | 7289 | 9098 | 132357 | 14706 | 139646 | | 139646 | | 137965 | 1681 |
| Gas | | | | | | | 5923 | 5923 | | |
| Light[2] HC | | | | | | | 79104 | | | 79104 |
| Residue | | | | | | 46950 | | | | |
| Sulfur | 7669 | | | | 7669 | 3323 | 4346 | 1059 | | 3287 |
| Catalyst | — | — | — | — | — | — | — | — | — | — |
| Total | 146935 | 9098 | 132357 | 14706 | 279292 | 50273 | 229019 | 6982 | 137965 | 84072 |

[1]Boscan heavy crude hydrocarbon containing 5 wgt % water used in Example 1.
[2]Light hydrocarbon product contains 2 wgt % water.
[3]In units of mass/hr.

EXAMPLE 6

This Example illustrates continuous operation of the process of the present invention in the flow reactor of FIG. 3 for treatment of 10,000 barrels/day feed of Boscan heavy oil with water and a water soluble catalyst material, e.g., formic acid or $(NH_4)_2CO_3$ which decomposes to give gases that are recovered in stream 341. Material balances are provided in Table VIII.

EXAMPLE 7

This Example illustrates continuous operation of the process of the present invention in the flow reactor of FIG. 3 for treatment of a 10,000 barrels/day feed of Boscan heavy oil with water and a catalyst material, e.g., $Fe_2O_3$ or pyrites or $Fe_2(SO_4)_3$ that is recovered in residue stream 325. Material balances are provided in Table IX.

TABLE VIII

Material Balance[3] for Treatment of Boscan Heavy Oil with Water and Selected Catalyst Materials, e.g., Formic acid or $(NH_4)_2CO_3$ at 410° C. and 1800 psia

| | Stream: | | | | | | | | | |
|---|---|---|---|---|---|---|---|---|---|---|
| Components | 301 | 302 | 303 | 308 | 309 | 325 | 329 | 341 | 349 | 353 |
| Heavy[1] HC | 131977 | | | | 131977 | | | | | |
| Water | 7289 | 9355 | 132357 | 14706 | 139646 | | 139646 | | 137708 | 1938 |
| Gas | | | | | | | 12576 | 12576 | | |
| Light[2] HC | | | | | | | 91170 | | | 91170 |
| Residue | | | | | | 35212 | | | | |
| Sulfur | 7669 | | | | 7669 | 2492 | 5177 | 1388 | | 3789 |
| Catalyst | | | | | 6982 | — | — | | | |
| Total | 146935 | 9355 | 132357 | 14706 | 286274 | 37704 | 248569 | 13964 | 137708 | 96897 |

[1]Boscan heavy crude hydrocarbon containing 5 wgt % water used in Example 1.
[2]Light hydrocarbon product contains 2 wgt % water.
[3]In units of mass/hr.

TABLE IX

Material Balance[3] for Treatment of Boscan Heavy Oil With Water And Selected Catalyst Materials, e.g., Iron Oxides, or Sulfides or Sulfates At 410° C. and 1800 psig

| | Stream: | | | | | | | | | |
|---|---|---|---|---|---|---|---|---|---|---|
| Components | 301 | 302 | 303 | 308 | 309 | 325 | 329 | 341 | 349 | 353 |
| Heavy[1] HC | 131977 | | | | 131977 | | | | | |
| Water | 7289 | 9583 | 132357 | 14706 | 139646 | | 139646 | | 137480 | 2166 |
| Gas | | | | | | | 4178 | 4178 | | |
| Light[2] HC | | | | | | | 101652 | | | 101652 |
| Residue | | | | | | 26147 | | | | |
| Sulfur | 7669 | | | | 7669 | 1782 | 5887 | 1408 | | 4479 |
| Catalyst | | | | | 419 | 419 | | | | |
| Total | 146935 | 92166 | 132357 | 14706 | 279711 | 28348 | 251363 | 5586 | 137480 | 108297 |

[1]Boscan heavy crude hydrocarbon containing 5 wgt % water used in Example 1.
[2]Light hydrocarbon product contains 2 wgt % water.
[3]In units of mass/hr.

EXAMPLE 8

This Example illustrates continuous operation of the process of the present invention in the flow reactor of FIG. 3 for treatment of a 10,000 barrels/day feed of Boscan heavy oil with water and a catalyst material, e.g., phenathrene (phenan) that is recovered in the light hydrocarbon oil product stream 353. Material balances are provided in Table X.

TABLE X

Material Balance[3] for Treatment of Boscan Heavy Oil with Water And a Selected Catalyst Material, e.g., Phenanthrene at 410° and 1800 psia

| | Stream: | | | | | | | | | |
|---|---|---|---|---|---|---|---|---|---|---|
| Components | 301 | 302 | 303 | 308 | 309 | 325 | 329 | 341 | 349 | 353 |
| Heavy[1] HC | 131977 | | | | 131977 | | | | | |
| Water | 7289 | 9428 | 132357 | 14706 | 139646 | | 139646 | | 137635 | 2011 |
| Gas | | | | | | | 1537 | 1537 | | |
| Light[2] HC | | | | | | | 100722 | | | 100722 |
| Residue | | | | | | 33903 | | | | |
| Sulfur | 7669 | | | | 7669 | 2400 | 5269 | 1257 | | 4012 |
| Catalyst | | | | | 4189 | | | | | |
| Total | 146935 | 9428 | 132357 | 14706 | 283481 | 36308 | 297174 | 2794 | 137635 | 106745 |

[1]Boscan heavy crude hydrocarbon containing 5 wgt % water used in Example 1.
[2]Light hydrocarbon product contains 2 wgt % water.
[3]In units of mass/hr.

EXAMPLE 9

This Example illustrates continuous operation of the process of the present invention in the flow reactor of FIG. 3 for treatment of a 10,000 barrels/day feed of Boscan heavy oil with water and a catalyst material, e.g., i—$C_3H_7OH$ that is recycled with water stream 349. Material balances are provided in Table XI.

TABLE XI

Material Balance[3] for Treatment of Boscan Heavy Oil with Water And Selected Catalyst Materials, e.g., i-$C_3H_7OH$ at 410° C. and 1800 psig

| | Stream: | | | | | | | | | |
|---|---|---|---|---|---|---|---|---|---|---|
| Components | 301 | 302 | 303 | 308 | 309 | 325 | 329 | 341 | 349 | 352 |
| Heavy[1] HC | 131977 | | | | 131977 | | | | | |
| Water | 7289 | 9176 | 132357 | 14706 | 139646 | | 139646 | | 137887 | 1759 |
| Gas | | | | | | | 6038 | 6038 | | |
| Light[2] HC | | | | | | | 84467 | | | 84467 |
| Residue | | | | | 7669 | 41472 | | | | |
| Sulfur | 7669 | | | | | 2935 | 4734 | 1224 | | 3510 |
| Catalyst | | 3297 | 25201 | 2738 | 27939 | | 27939 | | 27380 | 559 |
| Total | 146935 | 12473 | 157558 | 17444 | 307231 | 44407 | 262824 | 7262 | 165267 | 90295 |

[1]Boscan heavy crude hydrocarbon containing 5 wgt % water used in Example 1.
[2]Light hydrocarbon product contains 2 wgt % water.
[3]In units of mass/hr.

EXAMPLE 10

Figure 4:
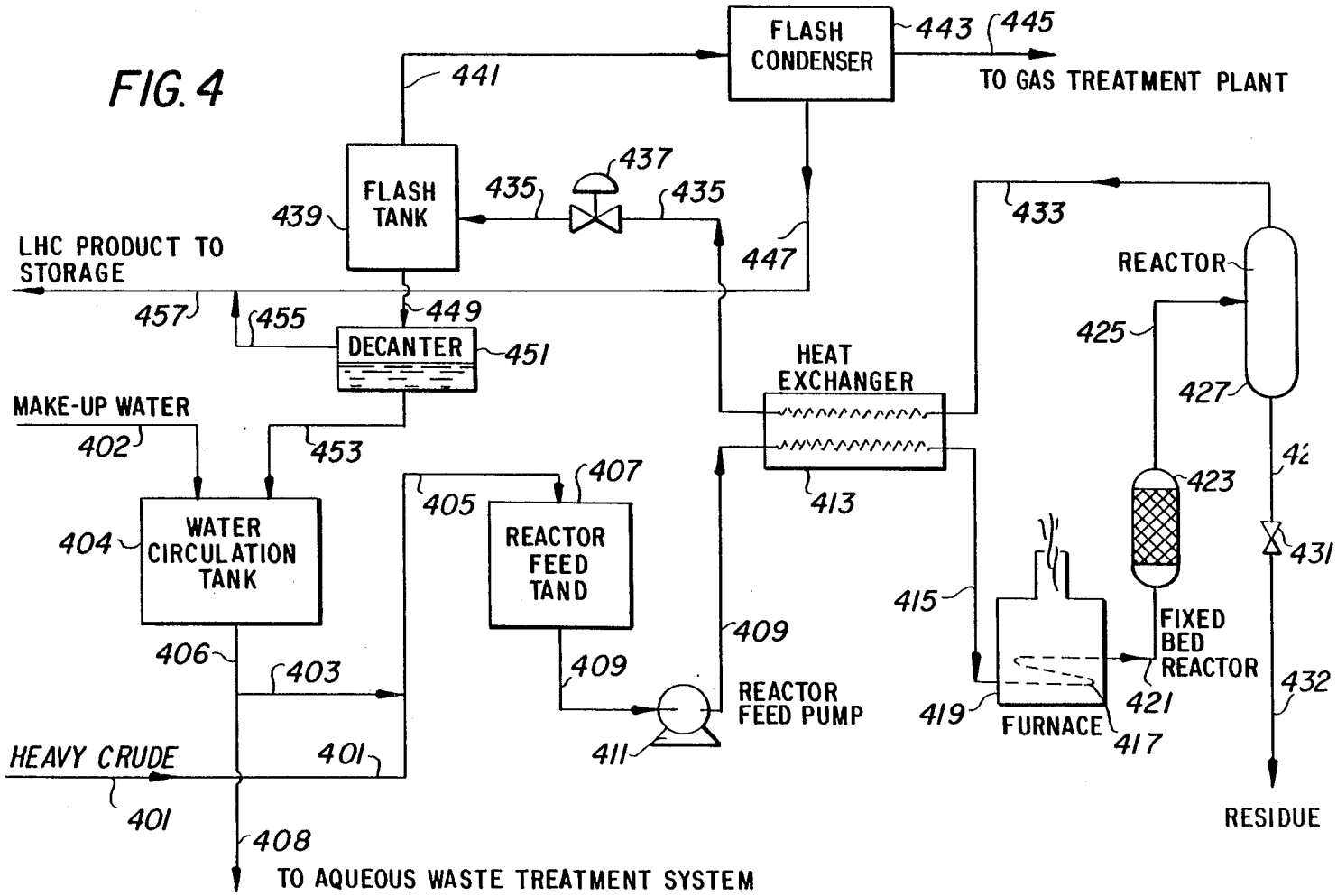
FIG. 4 is a schematic of another alternative preferred embodiment of the present invention operated in a flow reactor incorporating a fixed bed reactor.

This Example illustrates another alternative preferred embodiment for continuous operation of the process of the present invention in a flow reactor shown schematically in FIG. 4. FIG. 4 is similar to FIG. 3 but incorporates a fixed bed reactor 423 containing selected catalyst material such as rhodium metal on alumina or preferably the catalyst materials used in Example 7, e.g., $Fe_2O_3$ or $Fe_2(SO_4)_3$. As shown in FIG. 4, a heavy hydrocarbon feedstock, such as Boscan heavy crude oil in stream 401 is mixed with water in stream 403 and the mixture is fed via stream 405 to reactor feed tank 407. The mixture in 407 is removed therefrom via stream 409 containing pump 411 which pumps mixture in stream 409 to high pressure heat exchanger 413 which may be of any convenient design and then via stream 415 to high temperature preheater furnace 419 containing reaction zone 417. Preheater furnace 419 may conveniently be a high pressure direct-fired tubular heater. The reactor mixture from preheater furnace 419 is passed via stream 421 to fixed bed reactor 423 containing, for example, a fluidized bed of iron (II and/or III) sulfates. The reaction mixture is removed from 423 as stream 425 and forwarded to reactor 427. In reactor 427, the reaction mixture is separated into a vapor stream 433 suitable for further processing and/or transportation, and containing (1) $C_{1-C6}$ alkanes, hydrogen sulfide, carbon dioxide and trace amounts of hydrogen, (2) light hydrocarbons, and (3) water vapor, and a residue stream 429 equipped with pressure let-down valve 431 residue stream 429 may contain some catalytic material and may be used as fuel or at least partially recycled via stream 432 to preheater 419. The vapor stream 433 is passed through heat exchanger 413 to stream 435 containing pressure let-down valve 437 to flash tank 439 wherein the mixture of light hydrocarbons and gases is separated from water and removed from 439 via stream 441 to flash condenser 443. In flash condenser 443, gases are separated from light hydrocarbons; gaseous stream 445 may be removed therefrom for further processing in, for example, a gas treatment plant and light hydrocarbons is removed therefrom as stream 447. Water vapor in stream 435 is at least partially separated from the mixture of light hydrocarbons and gases in flash tank 439 and is removed therefrom via stream 449 to decanter 451 wherein residual light hydrocarbons are removed via stream 455 and combined with stream 447 to form light hydrocarbon product stream 457 which may be forwarded for further processing, e.g., hydrotreating. The water separated in 451 is removed as stream 453 to a water circulation tank 404 equipped with make-up water stream 402. Water from tank 404 is removed via stream 406 and at least a portion thereof is used as feed in stream 403 and the remainder is forwarded as stream 408 for water treatment.

The material balances for operation of a continuous process of the present invention using 10,000 barrels/-day of Boscan heavy oil with water in a fixed bed reactor containing for example iron sulfates are provided in Table XII*a* but do not necessarily reflect optimum or realizable conditions for the operation of the process. The temperature and pressures of selected streams are provided in Table XII*b*.

TABLE XIIa

Material Balance[3] for Treatment of Boscan Heavy Oil With Water And Selected Catalyst Materials Positioned in Fixed Bed Reactor at 410° C. and 1800 psig

| | Stream: | | | | | | | | | |
|---|---|---|---|---|---|---|---|---|---|---|
| Components | 401 | 402 | 403 | 408 | 409 | 429 | 433 | 445 | 453 | 457 |
| Heavy[1] HC | 131977 | | | | 131977 | | | | 137803 | 1843 |
| Water | 7289 | 9260 | 132357 | 14706 | 139646 | | 139646 | | | |
| Gas | | | | | | | 10884 | 10884 | | |
| Light[2] HC | | | | | | | 88489 | | | |
| Residue | | | | | | 32604 | | | | |
| Sulfur | 7669 | | | | 7669 | 2308 | 5361 | 1684 | | |
| Catalyst | | | | | | | | | | 3677 |
| Total | 146935 | 9260 | 132357 | 14706 | 279292 | 34912 | 244380 | 12568 | 137803 | 94009 |

[1]Boscan heavy crude hydrocarbon containing 5 wgt % water used in Example 1.
[2]Light hydrocarbon product oontains 2 wgt % water.
[3]In units of mass/hr.

TABLE XIIb

| Stream # | T (°C.) | P (psia) |
|---|---|---|
| 401 | 65 | atm[1] |
| 402 | 15 | " |
| 403 | 55 | " |
| 408 | 70 | " |
| 409 | 150 | 1800[2] |
| 423 | 410 | 1800[2] |
| 432 | 400 | atm[1] |
| 433 | 370 | 1700[3] |
| 445 | 60 | atm[1] |
| 453 | 60 | " |
| 457 | 60 | " |

Footnotes to Table XIIb
[1]atmospheric pressure
[2]12,400 kPa
[3]11,700 kPa

EXAMPLE 11

The tar sand bitumen of Examples 1–2 is treated with water and catalyst materials in the flow reactor illustrated in FIGS. 3 and 4 in accordance with procedure of Examples 5–10. Results similar to those reported in Examples 5–10 are expected.

EXAMPLE 12

Light hydrocarbon products were obtained by treatment of Boscan heavy crude oil with water in the semi-continuous reactor described in the general experimental section and in accordance with procedure of Example 1 at 410° C. and at pressures from atmospheric to 3500 psig in the absence of externally added catalyst. The API gravity and viscosity of these light hydrocarbon products were measured. The results are summarized in Table XIII. Similar results are expected in the presence of externally added catalyst.

TABLE XIII

Comparison of API Gravity and Viscosity of Boscan Heavy Oil

| | Run # | | | | | |
|---|---|---|---|---|---|---|
| Property | 28 Boscan Heavy Oil | 29 3500 psi, 410° C. | 30 2500 psi, 410° C. | 31 2000 psi, 410° C. | 32 1500 psi, 410° C. | 1000 psi, 410° C. |
| API Gravity[a] | 10.3 | 21.8 | 26.5 | 29.1 | 32.1 | 31.0 |
| Viscosity (25° C.) cp | 60,600 (at 22° C.) | 7.9 | 6.46 | 5.08 | 2.49 | 3.44 |

[a]API Gravity $= \frac{141.5}{\text{Spec. Gravity}} - 131.5$

EXAMPLE 13

The light hydrocarbon product from Run #31 of Table XIII was subjected to atmospheric distillation followed by vacuum distillation at successively lower pressures. The results are reported in Table XIV. Similar results are expected from distillation of Light Hydrocarbon product obtained from treatment of tar sand bitumen at 410° C./1500 psig.

TABLE XIV

Results from Distillation of Boscan Heavy Crude Oil and The Light Hydrocarbon Product of Run #31 of Table VIII

| Fraction Identity | Boiling Range[a] (°C.) | Boscan HCO[b] (wt %) | Light HC[c] (wt %) |
|---|---|---|---|
| Naphtha | 35–195[d] | 3.25 | 32.2 |
| Light Gas Oil | 195–260[d] | 3.85 | 21.76 |
| Heavy Gas Oil | 260–343[e] | 6.35 | 29.02 |
| | 343–530[e] | 27.70 | 17.5 |
| | 530[e] | | trace |

Footnotes to Table XIV
[a]Standard Boiling Points (corrected)
[b]Boscan Heavy Crude Oil used in Example 1–2
[c]Light Hydrocarbon Product from Run #31 of Table VIII (410° C./1500 psig)
[d]Distilled at atmospheric pressure
[e]Distilled at reduced pressure; boiling points corrected to one atmospheric pressure

COMPARATIVE EXAMPLE 14

This example illustrates treatment of Boscan heavy crude oil with water in an apparatus similar to that disclosed in U.S. Pat. No. 2,135,332 (Gary). The apparatus and procedure of FIG. 3 were used with the modification detailed herein below to provide for reduction of temperature and pressure to ambient before separation of residue from reaction mixture from which light hydrocarbon product is obtained.

In a typical experiment, Boscan heavy oil and water were pumped into a tubular reactor. The oil/$H_2O$ ratio and pump rate were varied. The tubular reactor 51 was heated to about ~465°–470° C. in a fluidized sand bath. The mixture product formed was directly transferred from tubular reactor 25 to a condensing flask 67 via line 61 through pressure control valve 65. Condensed oil and $H_2O$ were worked up in two steps: first, water was distilled off in vacuum. Second, the oil obtained was distilled according to ASTM type distillation methods. The results for a series of experiments wherein residence time in tubular heater 25 of FIG. 1 was varied are summarized in Table XV.

TABLE XV

Conversion of Boscan at 465° C.–470° C., 2000 psi in a Continuous Flow Tubular Reactor 51 of FIG. 3

| Residence Time Min, Sec. | Light Oil[a] wt % | Gas wt % |
|---|---|---|
| 6, 35[b] 76 | 1.25 | |
| 1, 40[c] 53.5 | 1.00 | |
| 1, 15 49.6 | 0.8 | |
| 0, 30 44.9 | 0.6 | |
| Virgin Boscan | 37.7[d] | — |

[a]Processed oil distilled after temperature and pressure letdown to ambient according to ASTM type method. Max. pot temp. 325° C., heating rate 2° C./min. Max. distillate temperature 225° C., Vac. 0.1 mm.
[b]At 6 min. 35 sec. residence time all the residue which might have been coke stayed in the coil. Plugging occured. Reaction was terminated after 100 g of Boscan heavy oil was fed to tubular reactor 25 (reactor volume equal to 73 g of oil).
[c]Slow build-up of coke formation in the tubular reactor.
[d]Vacuum distillate.

Two other experiments were run in the continuous flow tubular reactor 25 of FIG. 1 under identical conditions to those detailed above, except that the pressure was 2500 and 3500 psi, respectively. In both experiments, coke formation occurred thereby clogging the tubular reactor and the reaction was terminated after 100 g of Boscan heavy crude oil had been fed to tubular reactor 25.

Since various changes and modifications may be made in the invention without departing from the spirit thereof, it is intended that all the matter contained in the above description shall be interpreted as illustrative and not in a limiting sense.

We claim:

1. A process for catalytic conversion of heavy hydrocarbons having an API gravity at 25° C. of less than about 20 into light hydrocarbons having an API gravity at 25° C. of greater than about 20 and substantially free of vanadium and nickel values which comprises:

(a) contacting, in a reaction zone, said heavy hydrocarbons having an API gravity at 25° C. of less than about 20 with a liquid comprising water in the presence of an effective amount of a catalytic material consisting essentially of at least one member selected from the group consisting of oxides, sulfides of sulfates of iron, in the absence of externally added hydrogen, at a temperature between about 340° C. and 480° C. and at a pressure between about 1350 kPa and about 15,000 kpa;

(b) maintaining the reaction zone under said temperature and pressure in the absence of externally added hydrogen, for a time sufficient to produce a residue and a vapor phase comprising said light hydrocarbons, a gaseous product and a liquid comprising water;

(c) withdrawing the residue and said vapor phase from the reaction zone;

(d) separating said vapor phase into said gaseous product, said liquid comprising water, and said light hydrocarbons; and (e) recovering said light hydrocarbons.

2. The process of claim 1 wherein said catalytic material consists essentially of oxides, sulfides and sulfates of iron.

3. The process of claim 1 wherein the catalytic material consists essentially of iron oxides.

4. The process of claim 1 wherein the catalytic material consists essentially of iron sulfides.

5. The process of claim 1 wherein the temperature is between about 400° C. and 450° C. and wherein the pressure is between about 1350 kPa and about 3500 kPa.

6. The process of claim 1 wherein in step (a) the liquid comprising water further comprises at least one $C_1$–$C_4$ alcohol.

7. The process of claim 1 wherein the light hydrocarbons have a total vanadium and nickel content of less than about 50 ppm.

8. The process of claim 1 wherein the light hydrocarbons have a viscosity at 25° C. of less than about 10 cp.

9. The process of claim 1 wherein the gaseous product is less than 10 percent by weight of the heavy hydrocarbon stream.

10. The process of claim 6 wherein the light hydrocarbons have a total vanadium and nickel content of less than about 30 ppm.

11. The process of claim 7 wherein the heavy hydrocarbons have a viscosity at 25° C. of at least 30,000 cp.

12. A process for catalytic conversion of heavy hydrocarbons into light hydrocarbons which comprises:

(a) contacting, in a reaction zone, heavy hydrocarbons having an API gravity at 25° C. of less than about 20 with a liquid comprising water in the presence of an effective amount of a catalytic material comprising at least one member selected from the group consisting of ammonium carbonate and formic acid, in the absence of externally added hydrogen, at a temperature between about 340° C. and 480° C. and at a presure between about 1350 kPa and about 15,000 kPa;

(b) maintaining the reaction zone under said temperature and pressure in the absence of externally added hydrogen, for a time sufficient to produce a residue and a vapor phase comprising light hydrocarbons having an API gravity at 25° C. of greater than about 20 and substantially free of vanadium and nickel values, gaseous product and a liquid comprising water;

(c) withdrawing the residue and said vapor phase from the reaction zone;

(d) separating said vapor phase into said gaseous product, said liquid comprising water, and said light hydrocarbons having an API gravity at 25° C. of greater than about 20 and substantially free of vanadium and nickel values; and (e) recovering said light hydrocarbons.

13. A process for catalytic conversion of heavy hydrocarbons having an API gravity of 25° C. of less than about 20 derived from crude oils into light hydrocarbons having an API gravity at 25° C. of greater than about 20 and substantially free of vanadium and nickel values, said crude oils selected from the group consisting of tar sand oils, oil shale, heavy petroleum oil, and vacuum residue from petroleum oil, comprising the steps of:

(a) contacting, in a reaction zone, said heavy hydrocarbons having an API gravity at 25° C. of less than about 20 with a liquid comprising water in the presence of an effective amount of a catalytic material comprising at least one member selected from the group consisting of phenanthrene, ammonium carbonate, and formic acid, in the absence of externally added hydrogen, at a temperature between about 340° C. and 480° C. and at a pressure between about 1350 kPa and about 15,000 kPa;

(b) maintaining the reaction zone under said temperature and pressure in the absence of externally added hydrogen, for a time sufficient to produce a residue and a vapor phase comprising said light hydrocarbons having an API gravity at 25° C. of greater than about 20 and substantially free of vanadium and nickel values, gaseous product and a liquid compressing water;

(c) withdrawing the residue and said vapor phase from the reaction zone;

(d) separating said vapor phase into said gaseous product, said liquid comprising water, and said light hydrocarbons having an API gravity at 25° C. of greater than about 20 and substantially free of vanadium and nickel values; and (e) recovering said light hydrocarbons.

* * * * *